US006232268B1

(12) United States Patent
Narita et al.

(10) Patent No.: US 6,232,268 B1
(45) Date of Patent: May 15, 2001

(54) THERMAL TRANSFER IMAGE-RECEIVING SHEET

(75) Inventors: Satoshi Narita; Kazunobu Imoto; Takeshi Ueno; Yoshinori Kamikubo, all of Tokyo (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/219,431

(22) Filed: Dec. 23, 1998

Related U.S. Application Data

(62) Division of application No. 08/866,076, filed on May 30, 1997, now Pat. No. 5,902,770, which is a continuation of application No. 08/318,177, filed on Oct. 5, 1994, now abandoned.

(30) Foreign Application Priority Data

| | | |
|---|---|---|
| Oct. 8, 1993 | (JP) | 5-276028 |
| Jun. 22, 1994 | (JP) | 6-162992 |
| Jul. 14, 1994 | (JP) | 6-185471 |

(51) Int. Cl.[7] ..... B41M 5/035; B41M 5/38

(52) U.S. Cl. ..... 503/227; 428/304.4; 428/321.5; 428/913; 428/914

(58) Field of Search ..... 8/471; 428/195, 428/304.4, 913, 914, 211, 537.5; 503/227

(56) References Cited

U.S. PATENT DOCUMENTS

| | | | |
|---|---|---|---|
| 5,135,905 | 8/1992 | Egashira et al. | 503/227 |
| 5,284,817 | 2/1994 | Neumann | 503/227 |

FOREIGN PATENT DOCUMENTS

| | | |
|---|---|---|
| 0 454 428 A1 | 10/1991 | (EP) . |
| 0 495 617 A1 | 7/1992 | (EP) . |
| 0 544 283 A1 | 6/1993 | (EP) . |
| 0 545 317 A1 | 9/1993 | (EP) . |
| 61-270192 | 11/1986 | (JP) . |
| 63-87286 | 4/1988 | (JP) . |
| 2-3396 | 1/1990 | (JP) . |
| 2-80790 | 3/1990 | (JP) . |

*Primary Examiner*—Bruce H. Hess
(74) *Attorney, Agent, or Firm*—Parkhurst & Wendel, LLP

(57) ABSTRACT

Thermal transfer image-receiving sheet comprising paper as a substrate sheet and provided on the substrate sheet in the following order, and expanded layer and a receptive layer, and undercoat layer being provided between the substrate sheet and the expanded layer.

Also disclosed is a thermal transfer image-receiving sheet including a substrate sheet of paper composed mainly of pulp and, provided on the substrate sheet in the following order, and expanded layer, an intermediate layer and a receptive layer, the intermediate layer having been formed by coated an aqueous coating solution.

13 Claims, 1 Drawing Sheet

THERMAL TRANSFER IMAGE-RECEIVING SHEET

This is a Division of application Ser. No. 08/866,076 filed May 30, 1997, now U.S. Pat. No. 5,982,770 which in turn is a continuation of Ser. No. 08/318,177, filed Oct. 5, 1994, now abandoned.

BACKGROUND OF THE INVENTION

The present invention relates to a thermal transfer image-receiving sheet. More particularly, it relates to a thermal transfer image-receiving sheet having a dye-receptive layer of which the texture is similar to that of a so-called "plain papers."

A thermal transfer sheet comprising a substrate sheet and a dye layer provided on one surface of the substrate sheet has hitherto been used in an output printer for computers and word processors by a thermal sublimation dye transfer system. This thermal transfer sheet comprises a beat-resisting substrate sheet and a dye layer formed by coating an ink comprising a mixture of a binder with a sublimable dye on the substrate sheet and drying the resultant coating. Heat is applied to the thermal transfer sheet from the back surface thereof to transfer a number of color dots of three or four colors to a material on which an image is to be transferred, thereby forming a full color image. Since the colorant used is a dye, the image thus formed has excellent sharpness and transparency and high reproduction and gradation of intermediate colors, which enables a high-quality image comparable to a conventional full color photographic image to be formed.

Such a high-quality image, however, cannot be formed on a transfer material undyable with a dye, such as plain paper, in order to solve this problem, a thermal transfer image-receiving sheet comprising a substrate sheet and a dye-receptive layer previously formed on the substrate sheet has been used in the art.

Conventional thermal transfer image-receiving sheets are generally thick and have a dye-receptive layer of which the surface has a texture close to the so-called "photographic paper" rich in gloss, so that in some sense they can be said to give an impression of high grade.

However, in the so-called "applications in office," the gloss of the surface of the dye-receptive layer and the bard texture of the sheet per so give-a poor image to users. In order to overcome this problem, a thermal transfer image-receiving sheet, particularly one which has a surface having a texture close to plain paper and can be handled like copying paper, has been desired in the art.

DISCLOSURE OF THE INVENTION

The present invention has been made under these circumstances, and an object of the present invention is to provide a thermal transfer image-receiving sheet, particularly one which particularly has a surface having a texture close to plain paper and can be handled like copying paper.

In order to attain the above object, the first invention provides a the thermal transfer image-receiving sheet comprising a substrate sheet and a dye-receptive layer provided directly or through an intermediate layer on one surface of said substrate sheet, said dye-receptive layer having a surface roughness of center line average height Ra=1.0–4.0 $\mu$m, maximum height $R_{max}$=15.0–37.0 $\mu$m and 10-point average height Rz=10.0–30.0 $\mu$m.

Since the dye-receptive layer constituting the thermal transfer image-receiving sheet has a surface roughness falling within a particular range, the sheet has a surface having a texture close to plain paper and can be handled like copying paper and fits the needs of use in offices.

An image-receiving sheet using a conventional paper substrate sheet with an image being formed thereon is comparable to a print obtained by the conventional printing in texture, such as surface gloss and thickness, and, unlike an image-receiving sheet using the conventional synthetic paper as the substrate sheet, can be bent, and a plurality of sheets thereof may be put on top of one another for book-binding or filing, which renders the thermal transfer image-receiving sheet using paper as the substrate sheet suitable for various applications. Further, since plain paper is more inexpensive than synthetic paper, the image-receiving sheet can be produced at a lower cost. In such an image-receiving sheet, in order to compensate for the cushioning property of the substrate sheet, it is generally preferred to provide as an interposing layer a layer having a high cushioning property, for example, an expanded layer (foamed layer) comprising a resin and an expanding agent (foaming agent).

However, when an expandable layer to be converted to an expanded layer is formed directly on plain paper by coating, the coating solution is unfavorably penetrated into the plain paper as the substrate sheet. This renders the resultant expandable layer so thin that the expansion of an expanding agent contained in the expandable layer provides only a low expansion ratio, which makes it difficult to impart a desired cushioning property.

Further, when an expandable layer is formed on plain paper by coating an aqueous coating solution, the paper absorbs water, resulting in the occurrence of wrinkle and waviness on the paper.

Accordingly, an object of the present invention is to provide such a thermal-transfer image-receiving sheet that neither wrinkle nor waviness occurs at the time of forming an expandable layer, the expandable layer is highly expandable and the resultant expanded layer has a high cushion property.

Another object of the present invention is to provide a thermal transfer image-receiving sheet having excellent print quality, printing sensitivity and other properties and texture such as gloss and surface geometry comparable to paper.

In order to solve the above problems, the second invention provides a thermal transfer image-receiving sheet comprising paper as a substrate sheet and, provided on said substrate sheet in the following order, an expanded layer and a receptive layer, an undercoat layer being provided between said substrate sheet and said expanded layer.

In the thermal transfer image-receiving sheet of the present invention an undercoat layer is first formed on a substrate sheet, and an expandable layer to be converted to an expanded layer is formed thereon by coating. By virtue of this constitution, the coating solution for an expanded layer does not penetrate into the substrate sheet and can be easily expanded, so that an expanded layer having a high cushioning property can be formed. Further, since the penetration of the coating solution for an expanded layer into paper can be prevented, it is possible to prevent the occurrence of wrinkle and waviness on the substrate sheet.

Further, the provision of an intermediate layer between the expanded layer and the receptive layer is preferred for preventing the expanded layer from being collapsed by beating at the time of printing.

According to the finding of the present inventors however, when the intermediate layer is formed by coating a resin coating solution using an organic solvent, the coating solution for an intermediate layer collapses cells and voids of the expanded layer, so that a desired cushioning property cannot be attained. If an image is formed on such an image-receiving sheet, dropout or lack of uniformity in density occurs, so that no sharp image can be provided.

An image is formed by the migration of a dye held in the dye layer of the thermal transfer sheet to the image-receiving sheet by heating. In this case, the collapse of the expanded layer lowers the heat insulating properties of the expanded layer, which causes the heat necessary for the transfer of the dye to be diffused towards the back surface of the image-receiving sheet. This results in a lowering in printing sensitivity.

Particularly when the expandable layer is expanded with an expanding agent, such as a microsphere, the organic solvent In the intermediate layer dissolves a thermoplastic resin serving as the wall of the microsphere and consequently breaks the hollow of the microsphere, thus rendering the above phenomenon significant.

Accordingly, an object of the third invention is to provide a thermal transfer image-receiving sheet which has texture such as gloss and surface geometry comparable to paper, high printing sensitivity and causes neither dropout nor uneven density.

In order to solve the above problems, the third invention provides a thermal transfer image-receiving sheet comprising a substrate sheet of paper composed mainly of pulp and, provided on said substrate sheet in the following order, an expanded layer, an intermediate layer and a receptive layer, said intermediate layer having been formed by coating an aqueous coating solution.

In the thermal transfer image-receiving sheet according to the third invention, since the intermediate layer is formed by using an aqueous coating solution, it can be formed without breaking the cells of the expanded layer.

Further, since the intermediate layer and the receptive layer can be formed without breaking the surface geometry of the expanded layer, the geometry of a finely uneven surface of the expanded layer, as such can be imparted to the surface of the receptive layer.

DETAILED DESCRIPTION OF THE INVENTION

First Invention

Figure 1:
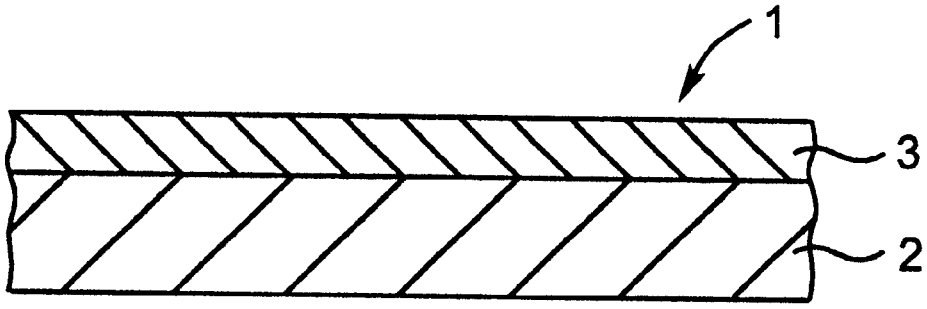
FIG. 1 is a cross-sectional view of the thermal transfer image-receiving sheet according to the first invention.

FIG. 1 is a schematic cross-sectional view of the thermal transfer image-receiving sheet according to the first invention. In FIG. 1, the thermal transfer image-receiving sheet 1 comprises a substrate sheet 2 and a dye-receptive layer 3 provided on one surface of the substrate sheet 2.

The-substrate sheet 2 may comprise a single layer of the so-called "paper" or "resin film (or sheet)." Alternatively, it may have a laminate structure comprising the above "paper" or "resin film (or sheet)" as a core substrate sheet and, laminated on at least one surface thereof, the so-called "synthetic paper." In order to provide a paper-like handle, it is preferred to positively use paper.

Specific examples of the "paper" include wood free paper, paper corresponding to printing paper A specified in JIS P3102, low quality paper, kraft paper, newsprint, glassine paper, art paper, coated paper, cast coated papers, wall paper, backed paper, paper impregnated with a synthetic resin, paper impregnated with an emulsion, paper impregnated with a synthetic rubber latex, paper with a synthetic resin being internally incorporated therein, fiber board, light-weight coated paper and slightly coated paper.

Specific examples of the resin film (or sheet) include resin films (or sheets) of polypropylene, polyethylene, polyesters, polycarbonates, polyethylene naphthalate, polyetheretherketone, polyamides, polyethersulfone, polystyrene and polyimides. If necessary titanium oxide, calcium carbonate, talc and other pigments and fillers may be added thereto. Further, an expansion-treatment may be carried out for weight reduction and other purposes.

The thickness of the substrate sheet 2 is in the range of from about 40 to 250 $\mu$m. In order to realize the texture close to plain paper for applications in OA (office automation), it is particularly preferably in the range of from 60 to 200 $\mu$m.

A dye-receptive layer 3 is formed directly or through an intermediate layer on the substrate sheet 2. The perceptive layer 3 serves to receive a sublimble dye transferred from a thermal transfer sheet and bold the dye thereon.

The dye-receptive layer 3 is composed mainly of a resin, and examples of the resin include polyolefin resins, such as polypropylene, halogenated polymers, such as polyvinyl chloride and polyvinylidene chloride, vinyl polymers, such as polyvinyl acetate and polyacrylic esters, polyester resins, such as polyethylene terephthalate and polybutylene torephthalate, polystyrene resins, polyamide resins, copolymer resins comprising olefins, such as ethylene or propylene, and other vinyl monomers, ionomers, cellulosic resins, such as cellulose diacetate, and polycarbonates. Among them, vinyl resins and polyester resins are particularly preferred.

In the present invention, the dye-receptive layer 3 is formed so that the surface roughness satisfies the following requirements.

The center line average height (Ra) of the surface of the dye-receptive layer 3 is in the range of from 1.0 to 4.0 $\mu$m, preferably in the range of from 1.1 to 3.5 $\mu$m, the maximum height ($R_{max}$) of the surface of the dye-receptive layer 3 is in the range of from 15.0 to 37.0 $\mu$m, preferably in the range of from 17.0 to 30.0 $\mu$m, and the 10-point average height (Rz) of the surface of the dye-receptive layer 3 is in the range of from 10.0 to 30.0 $\mu$m, preferably in the range of from 11.0 to 25.0 $\mu$m.

When even any one of the Ra, $R_{max}$ and Rz values exceeds the upper limit of the above Ra, $R_{max}$ and Rz ranges, the dye-receptive layer is rough to look at, which gives no impression of high grade but a strong impression of a low quality. Further, the unevenness of the surface has an adverse effect on the print quality and unfavorably leads to the lack of uniformity in print and the occurrence of pinholes. On the other hand, when even any one of the Rao, $R_{max}$ and Rz values is less than the lower limit of the above Ra, $R_{max}$ and Rz ranges, the surface appearance like plain paper cannot be realized and the appearance unfavorably like the conventional Phonographic paper. The center line average height (Ra), the maximum height ($R_{max}$) and the 10-point average height (Ra) are numerical wanes specified in JIS B0601-19828.

The specular glossiness ($G_s(45°)$) of the surface of the dye-receptive layer 3 is preferably not more than 40%, particular preferably in the range of from 2 to 15%.i The specular glossiness ($G_s(45°)$) is a numerical value specified in JIS-Z-8741-1983.

Preferred examples of methods for forming the dye-receptive layer 3 having a surface roughness falling within the above particular range include the following methods ① to ④.

Method ①: A particulate pigment, such as silica, calcium carbonate, alumina, kao clay, titanium dioxide, barium sulfate, zinc oxide or talc, is incorporated into a resin as a main component of the dye-receptive layer 3. In this case, the content of the particulate pigment is preferably in the tense of from 10 to 500% by weight. Method ②: A receptive layer comprising a resin as a main component of the dye-receptive layer 3 is previously formed, and the surface of the receptive layer 3 is then roughened while heating and pressing using a matting metal roller having a predetermined surface roughness. Method ③: A dye-receptive layer comprising the above resin is formed by coating on a substrate of a resin film (for example, a polyethylene terephthalate film), which has been previously matted so as to have a predetermined surface roughness, a substrate sheet 2 is laminated onto the dye-receptive layer through an adhesive, and the matted resin film is then pealed off from the dye-receptive layer to impart a predetermined surface roughness to the dye-receptive layer. This method is the so-called "transfer method." Method ④: An intermediate layer containing an expandable microcapsule is provided between the substrate sheet 2 and-the dye-receptive layer 3, and the expandable microcapsule is heated and expanded to impart a predetermined roughness to the surface of the dye-receptive layer. Examples of the expandable microcapsule include those prepared by microcapsulating a decomposable a expanding agent (foaming-agent), which decomposes on heating to evolve oxygen, carbon dioxide gas, nitrogen or other gases, such as dinitropentamethylenetatramine, diazoaminobenzene, azobisisobutyronitrile or azodicarboamide, or a low-boiling liquid, such as butane or pentane, in a resin such as polyvinylidene chloride or polyacrylonitrile.

The above microcapsule is incorporated into a binder resin, and the content thereof is preferably 1 to 150 parts by weight, still preferably 5 to 50 parts by weight, based on 100 parts by weight of the binder resin (solid basis). When the content is less than 1 part by weight, the cell effect, that is, cushioning property, beat insulation or the like, become unsatisfactory. This tendency is significant when the content is less than 5 parts by weight. On the other hand, when the content exceeds 150 parts by weight, the protection of the cells afforded by the binder resin is deteriorated. This tendency becomes particularly significant when the content exceeds 50 parts by weight.

The call diameter after the expansion of the microcapsule is in the range of from 10 to 100 $\mu$m, preferably 20 to 50 $\mu$m. When it is less than 10 $\mu$m, the cell effect is small. On the other hand, when it exceeds 100 $\mu$m, the surface roughness becomes excessively high, which has an adverse effect on the image quality.

The expanding agent may be incorporated in a material for the intermediate layer and, after drying of an intermediate layer, may be heated to the expansion temperature of the microcapsule used, thereby using the microcapsule. Alternatively, after the formation of an antedate layer by coating, the expansion may be carried out simultaneously with drying of the intermediate layer.

Thus, the method ④, unlike the method ①, eliminates the need to add the pigment, so that none of adverse effects (a deterioration in image quality, a feeling of roughness and a lowering in sensitivity and density) of the pigment do not occur. In addition, the method ④ has various advantages over the methods ② and ③, for example, in the elimination of the need to provide a special step or prepare a special film.

The dye-receptive layer 3 may be formed by air knife coating reverse roll coating, gravure coating, wire bar coating or other coating methods. The thickness of the dye-receptive layer 3 is preferably in the range of from about 1.0 to 10.0 $\mu$m.

In the present invention, besides the above expandable intermediate layer, an undercoat layer and an intermediate layer may be optionally provided. The format, material and location of the undercoat layer, expanded layer and intermediate layer are the same as those of the undercoat layer, expanded layer and intermediate layer which will be described below in connection with the third invention.

Further, in the present invention, an antistatic agent may be added to the dye-receptive layer 3. Examples of the antistatic agent include known antistatic agents, for example, cationic antistatic agents, such as quaternary ammonium salts and polyphone derivatives, anionic antistatic agents, such as alkyl photphates, and nonionic antistatic agents, such as fatty acid esters.

Furthermore, the so-called "back coat layer" may be provided on the back surface of the substrate sheet 2 for the purpose of imparting feedability and deliverability to the image-receiving sheet. An example of the back coat layer is an antistatic layer with the above antistatic agent being incorporated therein.

Second Invention

Preferred embodiments of the thermal transfer image-receiving sheet according to the second invention will now be described in detail.

Paper commonly used in the art may be used as the substrate sheet. The paper material for the substrate sheet is nor particularly limited, and examples thereof include wood free paper, art paper, lightweight coated slightly coated paper, coated paper, cast coated paper, paper impregnated with a synthetic resin or an emulsion, paper impregnated with a synthetic rubber latex, paper with a synthetic resin being internally incorporated therein and thermal transfer paper. Among them, wood free paper, lightweight coated paper, slightly coated paper, coated paper and thermal transfer paper are preferred. The coated paper and the like may be prepared by coating base paper with a resin Such as an SBR latex containing calcium carbonate, talc or the like. This type of resin layer cannot be sufficiently prevent the penetration of the coating solution for an expanded layer. Although some of the resin-impregnated paper, cast coated paper and the like have water resistance imparted by the impregnation or coating treatment, they are undesirable from the viewpoint of texture and cost.

When paper of the same type as used for proof reading in gravure printing, offset printing, screen printing and other Various types of printing is used as the substrate sheet, trial printing may be directly carried out using the image-receiving sheet of the present invention without proof.

Among other, offset printing paper and the like are designed to be dried at about 200° C., so that it is relatively resistant to heat and less likely to cause curling derived from heat wrinkle or beat shrinkage in the course of heating of the expandable layer (foamable layer) which will be described later. The thermal transfer paper too is less likely to cause curling derived from beat wrinkle and heat shrinkage in the course of heating of the expandable layer because it is designed to be heated by means of a thermal head when used.

The thickness of the substrate sheet used is in the range of from 40 to 250 μm, preferably in the range of from 60 to 200 μm. When it is contemplated for the resultant thermal transfer image-receiving sheet to have a texture like plain paper, the thickness of the thermal transfer image-receiving sheet is desirably in the range of from about 80 to 200 μm. In this case, the thickness of the substrate sheet is a value obtained by subtracting the total thickness (about 30 to 80 μm) of the layers formed on the substrate sheet, such as the undercoat layer, expanded layer, intermediate layer and receptive layer, from the thickness of the thermal transfer image-receiving sheet. When the substrate sheet used has a relatively small thickness of not more than 90 μm, it is likely to wrinkle due to absorption of water. In such a case, the effect of providing an undercoat layer is significant.

The colorant-receptive layer comprises a varnish composed mainly of a resin having a high dyability with a colorant and, optionally added to the varnish, various additives such as a release agent. Examples of the dyable resin include polyolefin resins, such as polypropylene, halogenated resins, such as polyvinyl chloride and polyvinylidene chloride, vinyl resins, such as polyvinyl acetate and polyacrylic esters, and copolymers thereof, polyester resins, such as polyethylene terephthalate and polybutylene terephthalate, polystyrene resins, polyamide resins, copolymer resins comprising olefins, such as ethylene or propylene, and other vinyl monomers, ionomers and cellulose derivatives. They may be used alone or in the form of a mixture of two or more. Among them, polyester resins and vinyl resins are particularly preferred. Further, any composite of the above resins may also be used.

It is also possible to-incorporate a release agent into the colorant-receptive layer for the purpose of preventing the colorant-receptive layer being fused to a thermal transfer sheet at the time of formation of an image. Silicone oils, phosphoric ester plasticizers and fluorocompounds may be used as the release agent. Among them, silicons oils are preferred. Preferred examples of the silicone oils include modified silicone oils such as epoxy-modified, alkyl-modified amino-modified, carboxyl-modified, alcohol-modified, fluorine-modified, alkylaralkyl-polyether-modified, epoxy-polyether-modified and polyether-modified silicone oils. Among others, a product of a reaction of a vinyl-modified silicone oil with a hydrogen-modified silicone oil provides goods results.

The amount of the release agent added is preferably in the range of from 0.2 to 30 parts by weight based on the resin for forming the receptive layer.

The colorant-receptive layer and other layers described below may be formed by roll coating, bar coating, gravure coating, gravure reverse coating and other conventional coating methods. The coverage of the colorant-receptive layer is preferably in the range of from 1.0 to 10 g/m$^2$ (on a solid basis; the coverage in the present invention being hereinafter on a solid basis unless otherwise specified).

In the present invention, an undercoat layer is formed on the substrate sheet. By virtue of the provision of the undercoat layer even when a coating solution for an expanded layer (foamed layer) is coated on the substrate sheet, the coating solution does not penetrate into the substrate sheet, so that an expandable layer having a desired thickness can be formed. Further, the expansion ratio in the expansion of the expandable layer by heating can be-increased, which contributes to an improvement in cushioning property of the whole image-receiving sheet and, at the same time, is cost-effective because the amount of the coating solution necessary for the formation of an expanded layer having a desired thickness can be reduced.

Resins usable as the undercoat layer include acrylic resins, polyurethane resins, polyester resins and polyolefin resins and modification products of the above resins.

In the present invention, paper is used as the substrate sheet. Therefore, when an aqueous coating solution for an undercoat layer is coated directly on the paper as the substrate sheet, a wrinkle or waviness occurs due to uneven water absorption of the surface of the substrate sheet, which often has an adverse effect of the texture or print quality. This tendency is particularly significant when the substrate sheet used has a small thickness of no more than 100 μm.

For this reason, the coating solution for an undercoat layer is preferably not aqueous but a coating solution in the form of a solution or a dispersion of the resin in an organic solvent.

Organic solvents usable for this purpose include toluene, methyl ethyl ketone, isopropanol, ethyl acetate, butanol and other general industrial organic solvents.

Further, extenders, such as talc, calcium carbonate, titanium oxide and barium sulfate, may be added to improve the coatability of the coating solution for an undercoat layer, improve the adhesion of the undercoat layer to the substrate sheet and the expanded layer (particularly, when an aqueous expanding agent is used in the formation of the expanded layer) or impart whiteness.

The coverage of the undercoat layer is preferably in the range of from 1 to 20 g/m$^2$. When it is less than 1 g/m$^2$ no contemplated effect as the undercoat layer can be attained. On the other hand, when it exceeds 20 g/m$^2$, the effect is saturated and the large coverage effects the texture of the substrate to cause a texture like a synthetic resin sheet. This is also cost-uneffective.

An expanded layer comprising a resin and an expanding agent (foaming agent) is formed on the undercoat layer. The cushioning property of the expanded layer is so high that a thermal transfer image-receiving sheet having a high printing sensitivity can be provided even when paper is used as the substrate sheet.

Conventional resins, such as urethane resins, acrylic resins, methacrylic resins and modified olefin resins, or blends of the above resins may be used as a resin for constituting the expanded layer. A solution and/or a dispersion of the above resin in an organic solvent or water is coated to form an expandable layer. The coating solution for an expanded layer is preferably an aqueous coating solution which does not have any effect on the expanding agent, and examples of the coating solution include coating solutions using water-soluble or water-dispersible resins, SBR latex, emulsions, such as a urethane emulsion, a polyester emulsion, an emulsion of vinyl acetate or a copolymer thereof, an emulsion of acryl or a copolymer of acryl, such as acryistyrene, and a vinyl chloride emulsion, or dispersions thereof. When a microsphere described below is used as the expanding agent, it is preferred to use an emulsion of vinyl acetate or a copolymer thereof, or an emulsion of acryl or a copolymer of acryl, such as acrylstyrene, among the above resins.

Since the-glass transition point, flexibility and film formability can be easily controlled as desired by varying the kind and ratio of monomers to be copolymerized these resins art advantageous in that desired properties can be obtained without the addition of any plasticizer or film forming aid and the resultant film is less likely to cause a change in color during storage under various environments and less likely to cause a change in properties with the lapse of time.

Further, among the above resins, SBR latex is not generally preferably used because it has a low glass transition point and is likely to cause blocking and the resultant film is likely to cause yellowing after the formation thereof during storage.

The urethane emulsion is not-preferably used because in many cases it contains solvents, such as NMP and DMF, which are likely to have an adverse effect on the expanding agent.

Further, the emulsion or dispersion of a polyester and the vinyl chloride emulsion are not preferably used because they generally have a high glass transition point and hence deteriorate the expendability of the microsphere. Although some of them are flexible, they too are not preferably used because the flexibility is imparted by the addition of a plasticizer.

The expanding property of the expanding agent is greatly influenced by the hardness of the resin. In order to attain a desired expansion ratio, the resin preferably has a glass transition point in the range of from −30 to 20° C. or a minimum film forming temperature of 20° C. or below. When the glass transition point is above 20° C., the flexibility is so low that the expanding property of the expanding agent is lowered. On the other hand, when the glass transition point is below −30° C., unfavorable phenomena often occur such as blocking (between the expanded layer and the back surface of the substrate sheet at the time of taking up the substrate sheet after the formation of the expanded layer) due to the tackiness of the resin and unsatisfactory cutting of the thermal transfer image-receiving sheet (occurrence of phenomena such as a deterioration in appearance of the thermal transfer image-receiving sheet due to sticking of the resin of the expanded layer to the cutting edge of a cutter or a deviation in cutting dimension at the time of cutting of the image-receiving sheet). When the minimum film forming temperature is above 20° C., a failure to form a film occurs during coating or drying, which results in occurrence of unfavorable phenomena such as surface cracking.

Examples of the expanding agent (foaming agent) include conventional expanding agents, such as decomposable expanding agents, which decompose on heating to evolve oxygen, carbon dioxide gas, nitrogen or other gases, ouch as dinitropentamthylanotetramine, diazoaminobenzene, azobisisobutyronitrile or azodicarbonamide, or microspheres prepared by emucrocapsulating a low-boiling liquid, such as butane or pentane, in a resin, such as polyvinylidene chloride or polyacrylonitrile. Among them, a microsphere prepared by enmicrocapsulating a low-boiling organic solvent, such as butane or pentane, in a thermplastic resin, such as polyvinylidene chloride or polyacrylonitrile, is preferred. These expanding agents expands on heating after the formation of an expandable layer, and the resultant expanded layer has high cushioning property and heat insulating properties.

The amount of the expanding agent used is preferably in the range of from 1 to 150 parts by weight, still preferably in the range of from 5 to 50 parts by weight, based on 100 parts by weight of the resin for forming the expanded layer. When it is less than 1 part by weight, the cushioning property of the expanded layer is so low that the effect of forming the expanded layer is lowered. On the other hand, when it exceeds 150 parts by weight, the percentage hollow after the expansion becomes so high that the mechanical strength of the expanded layer is lowered, which is disadvantageous in ordinary handling. Further, the surface of the expanded layer loses its smoothness, which is likely to have an adverse effect on the appearance and print quality.

The thickness of the whole expanded layer is preferably in the range of from 30 to 100 μm. When it is less than 30 μm, the cushioning property and the heat insulating property unsatisfactory. On the other hand, when it exceeds 100 μm, the effect of the expanded layer cannot be improved and the strength is unfavorably lowered.

The expanding agent is preferably such that the volume average particle diameter before expansion is in the range of from about 5 to 15 μm and the particle diameter after expansion is in the range of from 20 to 50 μm. When the volume average particle diameter before expansion is less than 5 μm and the particle diameter after expansion is less than 20 μm, the cushioning effect is low. On the other hand, when the volume average particle diameter before expansion exceeds 15 μm and the particle-diameter after expansion is in the range of from 20 to 50 μm or more, the surface of the expanded layer becomes uneven, which unfavorably has an adverse effect on the quality of the formed image.

The expanding agent is particularly preferably such a low temperature expanding microsphere that the softening temperature of the wall and the expansion initiation temperature are each 100° C. or below and the optimal expansion temperature (the temperature at which the highest expansion ratio is obtained with the heating time being 1 min) is 140° C. or below. In this case, the expansion is preferably carried out at as low a heating temperature as possible. The use of a microsphere having a low expansion temperature prevents the substrate sheet from wrinkling or curling on heating at the time of expansion.

The microsphere having a low expansion temperature can be prepared by regulating the amount of the thermoplastic resin incorporated for forming the wall of the microcapsule, such as polyvinylidene chloride or polyacrylonitrile. The volume average particle diameter of the microsphere is in the range of from 5 to 15 μm.

The expanded layer formed using the above microsphere has advantages including that cells formed by the expansion are closed cells, the expansion can be carried out by simply heating the expandable layer and the thickness of the expanded layer can be easily controlled as desired by varying the amount of the microsphere incorporated.

The microsphere, however, is less resistant to organic solvents and the use of a coating solution containing an organic solvent for the formation of an expanded layer causes the wall of the microsphere to be attacked by the organic solvent, which lowers the expanding property. For this reason, when the microsphere of the type described above is used, it is preferred to use an aqueous coating solution not containing such an organic solvent as will attack the wall, for example, ketones, such as acetone and methyl ethyl ketone, esters such as ethyl acetate, and lower alcohols, such as methanol and ethanol.

Therefore, the use of an aqueous coating solution, specifically a coating solution using a water-soluble or water-dispersible resin an emulsion of a resin, preferably an acrylstyrene emulsion or a modified vinyl acetate emulsion, is preferred.

Further, even when an expandable layer is formed using an aqueous coating solution, the addition of a high-boiling, high-polar solvent, for example, a co-solvent or film forming aid or a plasticizer, such as NMP, DMF or cellosolve, to the coating solution affects the microsphere, so that the composition of the aqueous resin used and the amount of the high-boiling solvent added should be properly selected by containing that they do not have an adverse effect on the microcapsule.

The expansion of the expanding agent contained in the expandable layer often causes a roughness in the order of several tons μm, and the surface of the receptive layer formed thereon also becomes uneven. Even though an image is formed on such a thermal transfer image-receiving sheet, the occurrence of dropouts and voids in the formed image is significant and an image having high sharpness and definition cannot be formed.

In order to solve this problem, proposals have been made such as a method wherein a smoothening treatment is carried out by calendering with heating and pressing and other methods, a method wherein a large amount of a resin is coated on the expanded layer to smoothen the surface of the expanded layer and a method which comprises forming on a rateable substrate sheet a receptive layer and an expanded layer in that order, laminating the resultant laminate onto a separately provided substrate sheet and peeling off the releasable substrate sheet alone to form an image-receiving sheet.

All the above methods, however, are not favorable because the number of process steps should be increased, a large amount of resin coating is necessary, or other members should be additionally used.

A good method for eliminating the problem associated with the uneven surface of the expanded layer is to provide on the expanded layer an intermediate layer comprising a flexible and elastic material. By virtue of the provision of the intermediate layer, a thermal transfer image-receiving sheet, which does not affect the print-quality, can be provided even when the surface of the receptive layer is uneven.

The intermediate layer comprises a resin having excellent flexibility and elasticity, specifically a urethane resin, a vinyl acetate resin, an acrylic resin, a copolymer of the above resins or a blend of the above resins.

Even when the above resin is used, the glass transition temperature is preferably in the range of from −30 to 20° C. When the glass transition temperature is below −30° C., the tackiness is so large that blocking (between the intermediate layer and the back surface of the substrate sheet) or unfavorable phenomena at the time of cutting of the thermal transfer image-receiving sheet occurs. On the other hand, when the glass transition temperature is above 20° C., the flexibility is so low that the above object cannot be attained.

If the coating solution for a receptive layer is a coating solution using an organic solvent, coating of the coating solution on the expanded layer causes the expanded layer to be attacked by the organic solvent, so that a cushioning property and other effects cannot be often attained by the expanded layer.

This problem can be solved by forming an intermediate layer using an aqueous coating solution between the expanded layer and the receptive layer. The aqueous coating solution does not contain organic solvents, for example, ketones, such as acetone and methyl ethyl ketone, esters such as ethyl acetate, and lower alcohols, such as methanol and ethanol. More specifically, the use of a coating solution using a water-soluble or water-dispersible resin, an emulsion of a resin, preferably an acrylic resin and/or acryl copolymer, is preferred.

The intermediate layer of the expanded layer may further comprise calcium carbonate, talc, kaolin, titanium oxide, zinc oxide and other conventional inorganic pigments and brightening agents for the purpose of imparting shielding properties and whiteness and regulating the texture of the thermal transfer image-receiving sheet. The amount of these optimal additives is preferably in the range of from 10 to 200 parts by weight based on 100 parts by weight of the resin (on a solid basis). When it is less than 10 parts by weight, the effect is unsatisfactory. On the other hand, when it exceeds 200 parts by weight, the dispersion stability is poor and the resin performance cannot often be attained.

The coverage of the intermediate layer is preferably in the range of from 1 to 20 g/m$^2$. When the coverage is less than 1 g/m$^2$, the function of protecting the cells cannot be sufficiently exhibited. On the other hand, when it exceeds 20 g/m$^2$, the heating insulating property, cushioning property and other properties of the expanded layer cannot be exhibited.

When the substrate sheet according to the present invention is used, if a plurality of resin layers are formed on the substrate sheet on the side of the receptive layer with the substrate sheet, such as plain paper, being exposed as such on the side of the back surface, the thermal transfer image-receiving sheet is likely to curl due to environmental moisture and temperature. For this reason, it is preferred to provide a curl preventive layer composed mainly of a resin having a water retaining property, such as polyvinyl alcohol or polyethylene glycol, on the back surface of the substrate sheet.

Further, it is also possible to provide a back surface layer having lubricity in the image-receiving sheet on its surface remote from the colorant-receptive layer according to a conveying system for the image-receiving sheet in a printer used. In order to impart the lubricity to the back surface layer, an inorganic or organic filler may be dispersed in the resin of the back surface layer. Examples of the resin used in the back surface layer having lubricity include conventional resins or a blend of the conventional resins.

Furthermore, a lubricating agent, such as a silicone oil, or a release agent may be added to the back surface layer. The coverage of the back surface layer is preferably in the range of from 0.05 to 3 g/m$^2$.

Thermal transfer sheets usable in thermal transfer, which is carried out using the above thermal transfer image-receiving sheet, include, beside a sublimation dye thermal transfer sheet used in the sublimation dye transfer recording system, a hot-melt thermal transfer sheet wherein a hot-melt ink layer comprising a hot-melt binder bearing a pigment is formed on the a substrate sheet by coating and the ink layer is transferred by heating to a material on which an image is to be formed.

Means for applying a thermal energy in the thermal transfer may be any conventional device. For example, an image can be formed by applying a thermal energy of about 5 to 100 mJ/mm$^2$ through the control of a recording time by means of a recording device, such as a thermal printer (for example, a video printer VY-100 manufactured by Hitachi, Limited).

Third Invention

Preferred embodiments of the thermal transfer image-receiving sheet according to the third invention will now be described in detail.

Paper composed mainly of pulp, which is commonly used in the art, may be used as the substrate sheet. Examples of the paper composed mainly of pulp include wood free paper, art paper, lightweight coated paper, slightly coated paper, coated paper, cast coated paper, paper impregnated with a synthetic resin or an emulsion, paper impregnated with a synthetic rubber latex, paper with a synthetic resin being internally incorporated therein and thermal transfer paper. Among then, wood free paper, lightweight coated paper, slightly coated paper, coated paper and thermal transfer paper are preferred. The coated paper and the like may be prepared by coating base paper with a resin such as an SBR latex containing calcium carbonate, talc or the like. This type of resin layer cannot be sufficiently prevent the penetration of the coating solution for an expanded layer (foamed layer). Although some of the resin-impregnated paper, cast coated paper and the like have water resistance imparted by the impregnation or coating treatment, they are undesirable from the viewpoint of texture and cost.

When paper of the same type as used for proof reading in gravure printing, offset printing, screen printing and other various types of printing is used as the substrate sheet, trail printing may be directly carried out using the image-receiving sheet of the present invention without proof.

Among other, offset printing paper and the like are designed to be dried at about 200° C., so that they are relatively resistant to heat and less likely to cause curling derived from heat wrinkle or heat shrinkage in the course of heating of the expandable layer which will be described later. The thermal transfer paper too is less likely to cause curling derived from heat wrinkle and heat shrinkage in the course of heating of the expandable layer because it is designed to be heated by means of a thermal head when used.

The thickness of the substrate sheet used is in the range of from 40 to 250 $\mu$m, preferably in the range of from 60 to 200 $\mu$m. When it is contemplated for the resultant thermal transfer image-receiving sheet to have a texture like plain paper, the thickness of the thermal transfer image-receiving sheet is desirably in the range of from about 80 to 200 $\mu$m. In this case, the thickness of the substrate sheet is a value obtained by subtracting the total thickness (about 30 to 80 $\mu$m) of the layers formed on the substrate sheet, such as the undercoat layer, expanded layer, intermediate layer and receptive layer, from the thickness of the thermal transfer image-receiving sheet. When the substrate sheet used has a relatively small thickness of not more than 90 $\mu$m, it is likely to wrinkle due to absorption of water. In such a case, the effect of providing an undercoat layer is significant.

The colorant-receptive layer comprises a varnish composed mainly of a resin having a high dyability with a colorant and, optionally added to the varnish, various additives such as a release agent. Examples of the dyable resin include polyolefin resins, such as polypropylene, halogenated resins, such as polyvinyl chloride and polyvinylidene chloride, vinyl resins, such as polyvinyl acetate and polyacrylic esters, and copolymers thereof, polyester resins, such as polyethylene terephthalate and polybutylene terephthalate, polystyrene resins, polyamide resins, copolymer resins comprising olefins, such as ethylene or propylene, and other vinyl monomers, ionomers and cellulose derivatives. They may be used alone or in the form of a mixture of two or more. Among them, polyester resins and vinyl resins are particularly preferred. Further, any composite of the above resins may also be used.

It is also possible to incorporate a release agent into the colorant-receptive layer for the purpose of preventing the colorant-receptive layer being fused to a thermal transfer sheet at the time of formation of an image. Silicone oils, phosphoric ester plasticizers and fluorocompounds may be used as the release agent. Among them, silicone oils are preferred. Preferred examples of the silicone oils include modified silicone oils such as epoxy-modified, alkyl-modified, amino-modified, carboxyl-modified, alcohol-modified, fluorine-modified, alkylaralkyl-polyether-modified, epoxy-polyether-modified and polyether-modified silicone oils. Among others, a product of a reaction of a vinyl-modified silicone oil with a hydrogen-modified silicone oil provides goods results.

The amount of the release agent added is preferably in the range of from 0.2 to 30 parts by weight based on the resin for forming the receptive layer.

The colorant-receptive layer and other layers described below may be formed by roll coating, bar coating, gravure coating, gravure reverse coating and other conventional coating methods. The coverage of the colorant-receptive layer is preferably in the range of from 1.0 to 10 g/m$^2$ (on a solid basis; the coverage in the present invention being hereinafter on a solid basis unless otherwise specified).

In the present invention, an undercoat layer may be formed on the substrate sheet. By virtue of the provision of the undercoat layer, even when a coating solution for an expanded layer is coated on the substrate sheet, the coating solution does not penetrate into the substrate sheet, so that an expandable layer having a desired thickness can be formed. Further, the expansion ratio in the expansion of the expandable layer by heating can be increased, which contributes to an improvement in cushioning property of the whole image-receiving sheet and, at the same time, is cost-effective because the amount of the coating solution necessary for the formation of an expanded layer having a desired thickness can be reduced.

Resins usable as the undercoat layer include acrylic resins, polyurethane resins, polyester resins and polyolefin resins and modification products of the above resins.

In the present invention, paper is used as the substrate sheet. Therefore, when an aqueous coating solution for an undercoat layer is coated directly on the paper as the substrate sheet, a wrinkle or waviness occurs due to uneven water absorption of the surface of the substrate sheet, which often has an adverse effect of the texture or print quality. This tendency is significant particularly when the substrate sheet used has a small thickness of not more than 100 $\mu$m.

For this reason, the coating solution for an undercoat layer is preferably not aqueous but a coating solution in the form of a solution or a dispersion of the resin in an organic solvent.

Organic solvents usable for this purpose include toluene, methyl ethyl ketone, isopropanol, ethyl acetate, butanol and other general industrial organic solvents.

Further, extenders, such as talc, calcium carbonate, titanium oxide and barium sulfate, may be added to improve the coatability of the coating solution for an undercoat layer, improve the adhesion of the undercoat layer to the substrate sheet and the expanded layer (particularly when an aqueous expanding agent is used in the formation of the expanded layer) or impart whiteness.

The coverage of the undercoat layer is preferably in the range of from 1 to 20 g/m$^2$. When it is less than 1 g/m$^2$, no contemplated effect as the undercoat layer can be attained. On the other hand, when it exceeds 20 g/m$^2$, the effect is saturated and the large coverage effects the texture of the substrate to cause a texture like a synthetic resin sheet. This is also cost-uneffective.

An expanded layer comprising a resin and an expanding agent (foaming agent) is formed on the undercoat layer. The cushioning property of the expanded layer is so high that a thermal transfer image-receiving sheet having a high printing sensitively can be provided even when paper is used as the substrate sheet.

Conventional resins, such as urethane resins, acrylic resins, methacrylic resins and modified olefin resins, or blends of the above resins may be used as a resin for constituting the expanded layer. A solution and/or a dispersion of the above resin in an organic solvent or water is coated to form an expandable layer. The coating solution for an expanded layer is preferably an aqueous coating solution which does not have any effect on the expanding agent, and examples of the coating solution include coating solutions using water-soluble or water-dispersible resins, SBR latex, emulsions, such as a urethane emulsion, a polyester emulsion, an emulsion of vinyl acetate or a copolymer thereof, an emulsion of acryl or a copolymer of acryl, such as acrylstyrene, and a vinyl chloride emulsion, or dispersions thereof. When a microsphere described below is used as the expanding agent, it is preferred to use an emulsion of vinyl acetate or a copolymer thereof, or an emulsion of acryl or a copolymer of acryl, such as acrylstyrene, among the above resins.

Since the glass transition point, flexibility and film formability can be easily controlled as desired by varying the kind and ratio of monomers to be copolymerized, these resins are advantageous in that desired properties can be obtained without the addition of any plasticizer or film forming aid and the resultant film is less likely to cause a change in color during storage under various environments and less likely to cause a change in properties with the lapse of time.

Further, among the above resins, SBR latex is not generally preferably used because it has a low glass transition point and is likely to cause blocking and the resultant film is likely to cause yellowing after the formation thereof during storage.

The urethane emulsion is not preferably used because in many cases it contains solvents, such as NMP and DMF, which are likely to have an adverse effect on the expanding agent.

Further, the emulsion or dispersion of a polyester and the vinyl chloride emulsion are not preferably used because they generally have a high glass transition point and hence deteriorate the expandability of the microsphere. Although some of them are flexible, they too are not preferably used because a plasticizer is added to impart the flexibility.

The expanding property of the expanding agent is greatly influenced by the hardness of the resin. In order to attain a desired expansion ratio, the resin preferably has a glass transition point in the range of from −30 to 20° C. or a minimum film forming temperature of 20° C. or below. When the glass transition point is above 20° C., the flexibility is so low that the expanding property of the expanding agent is lowered. On the other hand, when the glass transition point is below −30° C., unfavorable phenomena often occur such as blocking (between the expanded layer and the back surface of the substrate sheet at the time of taking up the substrate sheet after the formation of the expanded layer) due to the tackiness of the resin and unsatisfactory cutting of the thermal transfer image-receiving sheet (occurrence of phenomena such as a deterioration in appearance of the thermal transfer image-receiving sheet due to sticking of the resin of the expanded layer to the cutting edge of a cutter or a deviation in cutting dimension at the time of cutting of the image-receiving sheet). When the minimum film forming temperature is above 20° C., a failure to form a film occurs during coating or drying, which results in occurrence of unfavorable phenomena such as surface cracking.

Examples of the expanding agent include conventional expanding agents, such as decomposable expanding agents, which decompose on heating to evolve oxygen, carbon dioxide gas, nitrogen or other gases, such as dinitropentamethylenetetramine, diazoaminobenzene, azobisisobutyronitrile or azodicarbonamide, or microspheres prepared by enmicrocapsulating a low-boiling liquid, such as butane or pentane, in a resin, such as polyvinylidene chloride or polyacrylonitrile. Among them, a microsphere prepared by enmicrocapsulating a low-boiling liquid, such as butane or pentane, in a resin, such as polyvinylidene chloride or polyacrylonitrile, is preferred. These expanding agents expand on heating after the formation of an expandable layer, and the resultant expanded layer has high cushioning property and heat insulating properties.

The amount of the expanding agent used is preferably in the range of from 1 to 150 parts by weight based on 100 parts by weight of the resin for forming the expanded layer. When it is less than 1 part by weight, the cushioning property of the expanded layer is so low that the effect of forming the expanded layer cannot be attained. On the other hand, when it exceeds 150 parts by weight, the percentage hollow after the expansion becomes so high that the mechanical strength of the expanded layer is lowered, so that the image-receiving sheet cannot withstand ordinary handling. Further, the surface of the expanded layer loses its smoothness, which is likely to have an adverse effect on the appearance and print quality.

The thickness of the whole expanded layer is preferably in the range of from 30 to 100 μm. When it is less than 30 μm, the cushioning property and the heat insulating property become unsatisfactory. On the other hand, when it exceeds 100 μm, the effect of the expanded layer cannot be improved and the strength is unfavorably lowered.

The expanding agent is preferably such that the volume average particle diameter before expansion is in the range of from about 5 to 15 μm and the particle diameter after expansion is in the range of from 20 to 50 μm. When the volume average particle diameter before expansion is less than 5 μm and the particle diameter after expansion is less than 20 μm, the cushioning effect is low. On the other hand, when the volume average particle diameter before expansion exceeds 15 μm and the particle diameter after expansion is in the range of from 20 to 50 μm or more, the surface of the expanded layer becomes uneven, which unfavorably has an adverse effect on the quality of the formed image.

The expanding agent is particularly preferably such a low temperature expanding microsphere that the softening temperature of the wall and the expansion initiation temperature are each 100° C. or below and the optimal expansion temperature (the temperature at which the highest expansion ratio is obtained with the heating time being 1 min) is 140° C. or below. In this case, the expansion is preferably carried out at as low a heating temperature as possible. The use of a microsphere having a low expansion temperature prevents the substrate sheet from wrinkling or curling on heating at the time of expansion.

The microsphere having a low expansion temperature can be prepared by regulating the amount of the thermoplastic resin incorporated for forming the wall of the microcapsule, such as polyvinylidene chloride or polyacrylonitrile. The volume average particle diameter of the microsphere is in the range of from 5 to 15 μm.

The expanded layer formed using the above microsphere has advantages including that cells formed by the expansion are closed cells, the expansion can be carried out by simply heating the expandable layer and the thickness of the expanded layer can be easily controlled as desired by varying the amount of the microsphere incorporated.

The microsphere, however, is less resistant to organic solvents, and the use of a coating solution containing an organic solvent for the formation of an expanded layer causes the wall of the microsphere to be attacked by the organic solvent, which lowers the expanding property. For this reason, when the microsphere of the type described above is used, it is preferred to use an aqueous coating solution not containing such an organic solvent as will attack the wall, for example, ketones, such as acetone and methyl ethyl ketone, esters, such as ethyl acetate, and lower alcohols, such as methanol and ethanol.

Therefore, the use of an aqueous coating solution, specifically a coating solution using a water-soluble or water-dispersible resin, an emulsion of a resin, still preferably an acrylstyrene emulsion or a modified vinyl acetate emulsion, is preferred.

Further, even when an expandable layer is formed using an aqueous coating solution, the addition of a high-boiling, high-polar solvent, for example, a co-solvent or film forming aid or a plasticizer, such as NMP, DMF or cellosolve, to the coating solution affects the microsphere. Therefore, the composition of the aqueous resin used and the amount of the high-boiling solvent added should be properly selected by confirming that they do not have an adverse effect on the microcapsule.

In the present invention, the intermediate layer is formed by using an aqueous coating solution. The aqueous coating solution refers to an aqueous solution of a water-soluble resin, a dispersion of a resin or an emulsion of a resin. Preferably, it does not contain organic solvents, for example, ketones, such as acetone and methyl ethyl ketone, esters, such as ethyl acetate, lower alcohols, such as methanol and ethanol, and high-boiling, high-polar solvents, such as NMP, DMF and cellosolve. When the above organic solvent is contained in the coating solution, it is necessary to select such an organic solvent as will not affect the microsphere in the expanded layer or to regulate the organic solvent content.

The resin particle diameter is not more than 0.01 $\mu$m for the aqueous solution of a water-soluble resin, in the range of from about 0.01 to 0.1 $\mu$m of the dispersion of a resin and more than 0.1 $\mu$m for the emulsion. Among the above coating solutions, the emulsion is preferred for the following reasons.

In the water-soluble resin, the proportion of the hydrophilic portion in the polymer chain is so high that the formed coating has poor water resistance. Further, if a polymer having a high molecular weight is used as the water-soluble resin, the resultant aqueous solution has a high viscosity. For this reason, a resin having a low molecular weight should be used, so that the necessary coverage cannot be often obtained. Furthermore, since a crosslinking reaction is necessary in the formation of a film, heat treatment and other steps should be additionally provided. Furthermore, a hydrophilic organic solvent is added as an assistant for rendering the resin aqueous, and such an assistant may have an adverse effect on the microsphere in the expanded layer depending upon the kind and the amount thereof.

In the case of the emulsion, the molecular weight of the resin used does not affect the viscosity of the emulsion, so that a resin having a high molecular weight can be used. This enables good coating properties to be obtained without crosslinking reaction and other treatments. Further, a coating solution having a solid content and a low viscosity can be prepared, which facilitates the coverage. Furthermore, there is little or no need to use any organic solvent as an assistant, so that an adverse effect of the organic solvent on the expanded layer can be avoided.

The dispersion has properties between the aqueous solution of a water-soluble resin and the emulsion. For the above reasons, the use of the emulsion is preferred. However, the water-soluble resin and the dispersion too can be usefully employed if the following precautions are taken.

Specifically, a solution, dispersion or emulsion of a urethane resin, a vinyl acetate resin, an acrylic resin, a copolymer of the above resins or a blend of the above resins in water is used as a coating solution or an intermediate layer. The coating solution is coated on the expanded layer by various coating methods, and the resultant coating is then dried to form an intermediate layer. The intermediate layer (aqueous intermediate layer) composed mainly of the above water-soluble resin, water-dispersible resin or emulsion resin can cover the surface of the expanded layer without attacking the cells, particularly microspheres in the expanded layer. Therefore, the expanded layer having high cushioning property and heat insulating property can remain unchanged.

In order to impart a texture like plain paper to the thermal transfer image-receiving sheet, proposals have hitherto been made such as a method wherein the surface of the receptive layer is heated and pressed with a matting metal roll to impart matte feeling and a method which comprises providing a plurality of resin layers including a receptive layer on a plastic substrate sheet, which has been previously matted, laminating the resin layer to paper and peeling off the plastic substrate sheet, thereby forming on paper a resin layer having a matte feeling. Both the above methods, however, have drawbacks such as complicated process steps and occurrence of excessive wastes. By contrast, in the case of the thermal transfer image-receiving sheet using the above aqueous intermediate layer, the intermediate layer and the receptive layer can be formed while utilizing the roughness derived from microspheres of the expanded layer, so that a thermal transfer image-receiving sheet having natural matte feeling can be prepared without providing any special step.

The uneven portions formed on the surface of the receptive layer due to the influence of the roughness of the surface of the expanded layer often leads to occurrence of dropouts or voids when an image is formed. In order to solve this problem, proposals have been made such as a method wherein a smoothening treatment is carried out by calendering with heating and pressing and other methods, a method wherein a large amount of a resin is coated on the expanded layer to smoothen the surface of the expanded layer and a method which comprises forming on a releasable substrate sheet a receptive layer and an expanded layer in that order, laminating the resultant laminate onto a separately provided substrate sheet and peeling off the releasable substrate sheet alone to form an image-receiving sheet.

All the above methods, however, are not favorable because the number of process steps should be increased, a large amount of resin coating is necessary, or other members should be additionally used.

A good method for eliminating the problem associated with the uneven surface of the expanded layer is to provided on the expanded layer an intermediate layer comprising a flexible and elastic material. By virtue of the provision of the intermediate layer, a thermal transfer image-receiving sheet, which does not affect the print quality, can be provided even when the surface of the receptive layer is uneven.

The intermediate layer comprises a resin having excellent flexibility and elasticity. Specifically, among the above resins, those having a glass transition point in the range of from −30 to 20° C. are preferred. The use of the resin having a glass transition point in the range of from −30 to 20° C. enables an intermediate layer having a satisfactory flexibility to be formed, so that even though the surface of the receptive layer is uneven due to the influence of the roughness of the expanded layer, neither dropout nor uneven density occurs and a high-quality image can be provided.

When the glass transition temperature is below −30° C., the tackiness is so large that blocking (between the intermediate layer and the back surface of the substrate sheet) at the time of taking up the thermal transfer sheet or unfavorable phenomena at the time of cutting of the thermal transfer image-receiving sheet occurs. Further, the heat resistance is so poor that the surface of the image-receiving sheet is matted in the case of high-density printing to give a rough texture or a low reflection density. On the other hand, when the glass transition point is above 20° C., the flexibility becomes unsatisfactory, so that the effect of the cushioning property exerted by the expanded layer cannot be often attained.

Further, the use of a crosslinking resin as the resin for the intermediate layer is also preferred. The crosslinking resin causes a crosslinking reaction at the time of forming a coating, thereby forming a three-dimensional network structure which serves to improve the heat resistance and prevent the surface of the image-receiving sheet from being matted. Further, since the solvent resistance is also improved, even though the receptive layer is formed by a coating solution using an organic solvent, there is no fear of the intermediate layer and the expanded layer being attacked by the organic solvent. Furthermore, cells, particularly microspheres, in the expanded layer can be protected against heat at the time of drying of the intermediate layer or the receptive layer.

The use of a self-crosslinking resin among the crosslinking resins is preferred. The self-crosslinking resin is a resin which has in its polymer chain one or several kinds of heat-reactive functional groups which react with each other to form a crosslinked structure.

The reaction rate of the above self-crosslinking resin at a low temperature around room temperature is so low that the coating solution can be stably stored and hence is easy to handle and, further, does not deteriorate in the course of coating. After the coating, the crosslinked structure can be formed by heating and drying. Since the use of any curing agent, such as an isocyanate, is not required, the handleability is good. Furthermore, among the self-crosslinking resins, those which crosslink on heating, are preferred for simplification of equipment of reaction process.

The intermediate layer formed using a self-crosslinking resin neither loses its flexibility at a low temperature nor becomes liquid at a high temperature to exhibit rubber-like behaviour, so that the resistance to heat and scratch is so high that neither matting of the surface of the receptive layer nor scratch occurs even in the case of high-density printing.

The intermediate layer or the expanded layer may further comprise calcium carbonate, talc, kaolin, titanium oxide, zinc oxide and other conventional inorganic pigments and brightening agents for the purpose of imparting shielding properties and whiteness and regulating the texture of the thermal transfer image-receiving sheet. The amount of these optional additives is preferably in the range of from 10 to 200 parts by weight based on 100 parts by weight of the resin (on a solid basis). When it is less than 10 parts by weight, the effect is unsatisfactory. On the other hand, when it exceeds 200 parts by weight, the dispersion stability is poor and the resin performance cannot often be attained.

The coverage of the intermediate layer is preferably in the range of from 1 to 20 g/m$^2$. When the coverage is less than 1 g/m$^2$, the function of protecting the cells cannot be sufficiently exhibited. On the other hand, when it exceeds 20 g/m$^2$, the heating insulating property, cushioning property and other properties of the expanded layer cannot be exhibited.

When the substrate sheet according to the present invention is used, if a plurality of resin layers are formed on the substrate sheet on the side of the receptive layer with the substrate sheet, such as plain paper, being exposed as such on the side of the back surface, the thermal transfer image-receiving sheet is likely to curl due to environmental moisture and temperature. For this reason, it is preferred to provide a curl preventive layer composed mainly of a resin having a water retaining property, such as polyvinyl alcohol or polyethylene glycol, on the back surface of the substrate sheet.

Further, it is also possible to provide a back surface layer having lubricity in the image-receiving sheet on its surface remote from the colorant-receptive layer according to a conveying system for the thermal transfer image-receiving sheet in a printer used. In order to impart the lubricity to the back surface layer, an inorganic or organic filler is dispersed in the resin of the back surface layer. Examples of the resin used in the back surface layer having lubricity include conventional resins or a blend of the conventional resins.

Furthermore, a lubricating agent, such as a silicone oil, or a release agent may be added to the back surface layer. The coverage of the back surface layer is preferably in the range of from 0.05 to 3 g/m$^2$.

Thermal transfer sheets usable in thermal transfer, which is carried out using the above thermal transfer image-receiving sheet, include, beside a sublimation dye transfer sheet used in the sublimation dye transfer recording system, a hot-melt thermal transfer sheet wherein a hot-melt ink layer comprising a hot-melt binder bearing a pigment is formed on the a substrate sheet by coating and the ink layer is transferred by heating to a material on which an image is to be formed.

Means for applying a thermal energy in the thermal transfer may be any conventional device. For example, an image can be formed by applying a thermal energy of about 5 to 100 mJ/mm$^2$ through the control of a recording time by means of a thermal printer (for example, a video printer VY-100 manufactured by Hitachi, Limited).

The present invention will now be described in more detail with reference to the following examples and comparative examples.

EXAMPLE A1

A 62 $\mu$m-thick paper substrate sheet (Pyreen DX manufacture by Nippon Paper Industries Col., Ltd.) was provided as a substrate sheet.

A microcapsule-containing coating solution 1 having the following composition for an intermediate layer was coated on the substrate sheet by means of a wire bar at a coverage on a dry basis of 12 g/m$^2$, and the resultant coating was dried. Thereafter, the coated substrate sheet was allowed to stand in a hot-air drier of 150° C. for 1 min to heat and expand the microcapsule.

Coating Solution 1 for Microcapsule-Containing Intermediate Layer

| | |
|---|---|
| Emulsion (AE314 manufactured by Japan Synthetic Chemicals, Inc.) | 100 parts by weight |
| Expandable microcapsule (F50 manufactured by Matsumoto Yushi Seiyaku Co., Ltd.) | 30 parts by weight |
| Pure water | 30 parts by weight |

A coating solution 1 having the following composition for a dye-receptive layer was coated on the intermediate layer by means of a wire bar at a coverage on a dry basis of 4 g/m$^2$, and the resultant coating was dried, thereby preparing a sample of Example A1 according to the present invention.

Coating Solution 1 for Dye-Receptive Layer

| | |
|---|---|
| Vinyl chloride/vinyl acetate copolymer (#1000D manufactured by Denki Kagaku Kogyo K.K.) | 100 parts by weight |
| Amino-modified silicone (X-22-343 manufactured by The Shin-Etsu Chemical Co., Ltd.) | 3 parts by weight |
| Epoxy-modified silicone (KF-393 manufactured by The Shin-Etsu Chemical Co., Ltd.) | 3 parts by weight |
| Toluene/methyl ethyl ketone (1 part/1 part) | 500 parts by weight |

EXAMPLE A2

A sample of Example A2 according to the present invention was prepared in the same manner as in Example A1, except that a 75 μm-thick paper substrate sheet (Sunflower manufactured by Oji Paper Co., Ltd.) was used instead of the substrate sheet used in Example A1.

EXAMPLE A3

A sample of Example A3 according to the present invention was prepared in the same manner as in Example A1, except that an 88 μm-thick paper substrate sheet (New Age manufactured by Kanzaki Paper Mfg. Co. Ltd.) was used instead of the substrate sheet used in Example A1.

EXAMPLE A4

A 62 μm-thick paper substrate sheet (Pyreen DX manufactured by Nippon Paper Industries Co., Ltd.) was provided as a substrate sheet.

A coating solution 2 having the following composition for an intermediate layer was coated on the substrate sheet by means of a wire bar at a coverage on a dry basis of 12 g/m$^2$.

Coating Solution 2 for Intermediate Layer

| | |
|---|---|
| Emulsion (AE314 manufactured by Japan Synthetic Chemicals, Inc.) | 100 parts by weight |
| Pure water | 30 parts by weight |

A coating solution 2 having the following composition for a dye-receptive layer was coated on the intermediate layer by means of a wire bar at a coverage on a dry basis of 4 g/m$^2$, and the resultant coating was dried, thereby preparing a sample of Example A4 according to the present invention.

Coating Solution 2 for Dye-Receptive Layer

| | |
|---|---|
| Vinyl chloride/vinyl acetate copolymer (#1000D manufactured by Denki Kagaku Kogyo K.K.) | 100 parts by weight |
| Amino-modified silicone (X-22-343 manufactured by The Shin-Etsu Chemical Co., Ltd.) | 3 parts by weight |
| Epoxy-modified silicone (KF-393 manufactured by The Shin-Etsu Chemical Co., Ltd.) | 3 parts by weight |
| Ultrafine particles of anhydrous silica (AEROSIL 200 manufactured by Nippon Aerosil Co., Ltd.) | 100 parts by weight |
| Toluene/methyl ethyl ketone (1 part/1 part) | 500 parts by weight |

EXAMPLE A5

A sample of Example A5 according to the present invention was prepared in the same manner as in Example A4, except that a 75 μm-thick paper substrate sheet (Sunflower manufactured by Oji Paper Co., Ltd.) was used instead of the substrate sheet used in Example A4.

EXAMPLE A6

The coating solution 1 for a dye-reception layer used in Example A1 was coated on a matted polyethylene terephthalate film (Sandmax manufactured by Teijin Ltd.) by means of a wire bar at a coverage on a dry basis of 4 g/m$^2$, and the resultant coating was dried. Then, the coating solution 2 for an intermediate layer used in Example 4 was coated on the dye-receptive layer by means of a wire bar at a coverage on a dry basis of 12 g/m$^2$, and the resultant coating was dried. Thereafter, a coating solution 1 having the following composition for an adhesive layer was coated on the intermediate layer by means of a wire bar at a coverage on a dry basis of 5 g/m$^2$, and the resultant coating was dried. The substrate sheet (Pyreen DX manufactured by Nippon Paper Industries Co., Ltd.) used in Example A1 was laminated onto the adhesive layer. Thereafter, the matted polyethylene terephthalate was peeled off, thereby preparing a sample of Example A6 according to the present invention.

Coating Solution 1 for Adhesive Layer

| | |
|---|---|
| Vinyl acetate adhesive (Esdine 1011 manufactured by Sekisui Chemical Co., Ltd.) | 100 parts by weight |
| Toluene/methyl ethyl ketone (1 part/1 part) | 300 parts by weight |

EXAMPLE A7

A sample of Example A7 according to the present invention was prepared in the same manner as in Example A6, except that a 75 μm-thick paper substrate sheet (Sunflower manufactured by Oji Paper Co., Ltd.) was used instead of the substrate sheet used in Example A6 and the following coating solution 3 for a dye-receptive layer was used instead of the coating solution 1 for a dye-receptive layer used in Example A6.

Coating Solution 3 for Dye-receptive Layer

| | |
|---|---|
| Vinyl chloride/vinyl acetate copolymer (VYHD manufactured by Union Carbide Corporation) | 100 parts by weight |
| Amino-modified silicone (KS-343 manufactured by The Shin-Etsu Chemical Co., Ltd.) | 3 parts by weight |
| Epoxy-modified silicone (KF-393 manufactured by The Shin-Etsu Chemical Co., Ltd.) | 3 parts by weight |
| Antistatic agent (Plysurf A208B manufactured by Dai-Ichi Kogyo Seiyaku Co., Ltd.) | 2 parts by weight |
| Toluene/methyl ethyl ketone (1 part/1 part) | 500 parts by weight |

EXAMPLE A8

A 81 $\mu$m-thick paper substrate sheet (OK Supercoat manufactured by Oji Paper Co., Ltd., 104.72 g/m$^2$) was provided as a substrate sheet.

A coating solution 2 having the following composition for an intermediate layer was coated on the substrate sheet by means of a wire bar at a coverage on a dry basis of 15 g/m$^2$, and the resultant coating was dried.

Coating Solution 2 for Intermediate Layer

| | |
|---|---|
| Emulsion (XB4085 manufactured by Tohpe Corporation) | 100 parts by weight |
| Pure water | 30 parts by weight |

The coating solution 1 for a dye-receptive layer used in Example A1 was coated on the intermediate layer by means of a wire bar at a coverage on a dry basis of 4 g/m$^2$, and the resultant coating was dried. Thereafter, the surface of the dye-receptive layer was subjected to surface treatment in such a manner that it was heated and pressed by means of a matting metal roll under the following conditions, thereby preparing a sample of Example A8 according to the present invention.

Conditions for Surface Treatment using Matting Metal Roll

Matting metal roll surface: Ra=3.0 $\mu$m, $R_{max}$=30.0 $\mu$m, Rz=25.0 $\mu$m Matting metal roll temp.: 90° C.

Contact pressure: 2 Kg/cm$^2$

Speed: 5 m/min

EXAMPLE A9

A sample of Example A9 according to the present invention was prepared in the same manner as in Example A8, except that the conditions for the surface treatment using the matting metal roll were varied as follows.

Conditions for Surface Treatment using Matting Metal Roll

Matting metal roll surface: Ra=3.4 $\mu$m, $R_{max}$=35.0 $\mu$m, Rz=28.0 $\mu$m Matting metal roll temp.: 100° C.

Contact pressure: 2.3 Kg/cm$^2$

Speed: 5 m/min

COMPARATIVE EXAMPLE A1

A sample of Comparative Example A1 was prepared in the same manner as in Example A1, except that the expandable microcapsule was removed from the microcapsule-containing coating solution 1 for an intermediate layer used in Example A1.

COMPARATIVE EXAMPLE A2

A sample of Comparative Example A2 was prepared in the same manner as in Example A6, except that a conventional polyethylene terephthalate film (Lumirror manufactured by Toray Industries, Inc., 12 $\mu$m), which had not been matted, was used instead of the matted polyethylene terephthalate film used in Example A6.

The thermal transfer image-receiving sheet samples (Examples A1 to A9 and Comparative Examples A1 and A2) thus prepared were subjected to the following measurement and evaluation.

Measurement and Evaluation Items (1) Surface roughness (JIS B0601 1982)

The center line average height (Ra), maximum height ($R_{max}$) and 10-point average roughness (Rz) with respect to the surface roughness of the dye-receptive layer 3 were measured using as a measuring apparatus Surfcom 570A-3DF manufactured by Tokyo Seimitsu Co., Ltd.

(2) Specular gloss of surface ($G_8$ (45°))

The specular gloss of the surface was measured using as a measuring apparatus a varied-angle gloss meter VG-1001DP manufactured by Nippon Denshoku Co., Ltd. according to JISZ-8741-1983.

(3) Texture of surface (dye-receptive layer) of thermal transfer image-receiving sheet The surface texture of the dye-receptive layer was evaluated by visual inspection and touch according to a sensory test. The criteria for the evaluation were as follows.

◎ . . . Suitable matte feeling with texture similar to that of plain paper

○ . . . No difference in texture from plain paper

Δ . . . Somewhat difference in texture from plain paper

X . . . Apparent difference in texture from plain paper

The results of the measurement and evaluation were given in the following Table 1.

TABLE A1

(Results)

| Thermal transfer image-receiving sheet | Ra ($\mu$m) | $R_{max}$ ($\mu$m) | $R_z$ ($\mu$m) | Gs (45°) (%) | Texture of receptive layer |
|---|---|---|---|---|---|
| Ex. A1 | 1.9 | 24.9 | 20.0 | 8.0 | ◎ |
| Ex. A2 | 1.7 | 23.7 | 19.7 | 7.5 | ◎ |
| Ex. A3 | 1.7 | 24.8 | 17.6 | 7.6 | ◎ |
| EX. A4 | 1.1 | 15.8 | 10.7 | 12.0 | ○ |
| Ex. A5 | 1.1 | 16.2 | 11.5 | 10.5 | ○ |
| Ex. A6 | 1.2 | 18.5 | 11.2 | 4.8 | ◎ |
| Ex. A7 | 1.3 | 17.6 | 10.5 | 5.5 | ◎ |

TABLE A1-continued (Results)

| Thermal transfer image-receiving sheet | Ra (μm) | $R_{max}$ (μm) | $R_z$ (μm) | Gs (45°) (%) | Texture of receptive layer |
|---|---|---|---|---|---|
| Ex. A8 | 2.9 | 28.5 | 23.0 | 15.0 | ○ |
| Ex. A9 | 3.2 | 33.0 | 27.0 | 13.0 | ○-Δ |
| Comp. Ex. A1 | 0.6 | 5.4 | 3.4 | 61.0 | X |
| Comp. Ex. A2 | 0.7 | 2.6 | 1.8 | 66.0 | X |

The above results clearly shows the effect of the present invention. Specifically, according to the present invention, since the dye-receptive layer constituting the thermal transfer image-receiving sheet has a surface roughness falling within a specific range, the surface of the dye-receptive layer has a texture close to plain paper and, hence, can satisfy requirements for use in offices.

EXAMPLE B1

A coated paper having a basis weight of 104.7 g/m$^2$ (Mitsubishi New V Matt Kote manufactured by Mitsubishi Paper Mills Limited) was provided as a substrate sheet, and a coating solution having the following composition for an undercoat layer was gravure-coated on the substrate sheet at a coverage of 5 g/m$^2$ (weight on a dry basis; the same shall apply hereinafter). The resultant coating was dried by a hot-air drier to form an undercoat layer.

Units for expressing the composition are parts by weight unless otherwise specified.

Coating Solution for Undercoat Layer

| | |
|---|---|
| Polyester resin (V600 manufactured by Toyobo Co., Ltd.) | 100 parts |
| Methyl ethyl ketone/toluene = 1/1 | 200 parts |

Then, a coating solution having the following composition for an expanded layer was gravure-coated on the undercoat layer at a coverage of 20 g/m$^2$. thereafter, the resultant coating was dried and heated at 140° C. for 1 min by a hot-air drier to expand the microsphere.

Coating Solution for Expanded Layer

| | |
|---|---|
| EVA Emulsion (XB3647B manufactured by Tohpe Corporation) | 100 parts |
| Microsphere (551WU20 manufactured by Expancel; expansion initiation temp. = 99–104° C.) | 20 parts |
| Water | 20 parts |

Then, a coating solution having the following composition for an intermediate layer was gravure-coated on the expanded layer at a coverage of 5 g/m$^2$. Thereafter, the resultant coating was dried by a hot-air drier.

Coating Solution for Intermediate Layer

| | |
|---|---|
| Acrylic/styrene emulsion (RX832A manufactured by Nippon Carbide Industries Co., Ltd.) | 100 parts |
| Water | 20 parts |

Then, a coating solution having the following composition for a receptive layer was gravure-coated on the intermediate layer at a coverage of 3 g/m$^2$. Thereafter, the resultant coating was dried by a hot-air drier.

Coating Solution for Receptive Layer

| | |
|---|---|
| Vinyl chloride/vinyl acetate copolymer (#1000D manufactured by Denki Kagaku Kogyo K.K.) | 100 parts |
| Amino-modified silicone (X-22-349 manufactured by The Shin-Etsu Chemical Co., Ltd.) | 3 parts |
| Epoxy-modified silicone (KF-393 manufactured by The Shin-Etsu Chemical Co., Ltd.) | 3 parts |
| Methyl ethyl ketone/toluene = 1/1) | 400 parts |

A coating solution having the following composition for a back surface layer was gravure-coated on the substrate sheet on its side remote from the receptive layer at a coverage of 0.05 g/m$^2$. Thereafter, the resultant coating was dried by means of a cold-air drier, thereby preparing the thermal transfer image-receiving sheet of Example B1.

Coating Solution for Back Surface Layer

| | |
|---|---|
| Polyvinyl alcohol (PVA124 manufactured by Kuraray Co., Ltd.) | 2 parts |
| Water | 100 parts |

EXAMPLE B2

A thermal transfer image-receiving sheet of Example B2 was prepared in the same manner as in Example B1, except that a coated paper having a basis weight of 127.9 g/m$^2$ (OK Coat manufactured by New Oji Paper Co., Ltd.) was provided as a substrate sheet, and the compositions of the undercoat layer, expanded layer and intermediate layer were varied as follows.

Coating Solution for Undercoat Layer

| | |
|---|---|
| Acrylic resin (EM manufactured by Soken Chemical Engineering Co., Ltd.) | 100 parts |
| Precipitated barium sulfate (#300 manufactured by Sakai Chemical Co., Ltd.) | 30 parts |
| Toluene | 400 parts |

Expanded Layer

| | |
|---|---|
| Styrene acrylic emulsion (RX941A manufactured by Nippon Carbide Industries Co., Ltd.) | 100 parts |
| Microsphere (F30VS manufactured by Matsumoto Yushi Kagaku K.K., expansion initiation temp. = 80° C.) | 10 parts |
| Water | 20 parts |

Coating Solution for Intermediate Layer

| | |
|---|---|
| Acrylic emulsion (FX337C manufactured by Nippon Carbide Industries Co., Ltd.) | 100 parts |
| Water | 20 parts |

EXAMPLE B3

A thermal transfer image-receiving sheet of Example B3 was prepared in the same manner as in Example B1, except that a thermal transfer paper having a basis weight of 79.1 g/m$^2$ (TTR-T manufactured by Mitsubishi Paper Mills, Ltd.) was provided as a substrate sheet, and the compositions of the undercoat layer, expanded layer and intermediate layer were varied as follows.

Coating Solution for Undercoat Layer

| | |
|---|---|
| Urethane resin (NL2371M30 manufactured by Mitsui Toatsu Chemicals, Inc.) | 100 parts |
| Titanium oxide (TCA888 manufactured by Tohchem Products Corporation) | 30 parts |
| Ethyl acetate | 100 parts |
| Dimethylformamide | 20 parts |
| Isopropanol | 300 parts |

Coating Solution for Expanded Layer

| | |
|---|---|
| Acrylic emulsion (AE312 manufactured by Japan Synthetic Chemicals, Inc.) | 100 parts |
| Microsphere (F30SS manufactured by Matsumoto Yushi Kagaku K.K., Japan; expansion initiation temp. = 80° C.) | 15 parts |
| Water | 20 parts |

Coating Solution for Intermediate Layer

| | |
|---|---|
| Styrene/acrylic emulsion (XA4270C manufactured by Tohpe Corporation) | 100 parts |
| Titanium oxide (TT-055 (A) manufactured by Ishihara Sangyo Kaisha Ltd.) | 50 parts |
| Water | 30 parts |

EXAMPLE B4

A thermal transfer image-receiving sheet of Example B4 was prepared in the same manner as in Example B1, except that 551WU manufactured by Expancel (expansion initiation temp.=99–104° C.) was used instead of the microsphere contained in the expanded layer in Example B1.

EXAMPLE B5

A thermal transfer image-receiving sheet of Example B5 was prepared in the same manner as in Example B2, except that the composition of the undercoat layer in Example B2 was varied as follows.

Coating Solution for Undercoat Layer

| | |
|---|---|
| Acrylic emulsion (AE932 manufactured by Japan Synthetic Chemicals, Inc.) | 100 parts |
| Water | 20 parts |

COMPARATIVE EXAMPLE B1

A thermal transfer image-receiving sheet of Comparative Example B1 was prepared in the same manner as in Example B1, except that the formation of the undercoat layer was omitted.

COMPARATIVE EXAMPLE B2

A thermal transfer image-receiving sheet of Comparative Example B2 was prepared in the same manner as in Example B2, except that the formation of the undercoat layer and the intermediate layer was omitted.

COMPARATIVE EXAMPLE B3

A thermal transfer image-receiving sheet of Comparative Example B3 was prepared in the same manner as in Example B3, except that the formation of the undercoat layer and back surface layer was omitted.

COMPARATIVE EXAMPLE B4

A thermal transfer image-receiving sheet of Comparative Example B4 was prepared in the same manner as in Example B4, except that the formation of the undercoat layer and expanded layer was omitted.

The results of evaluation for the thermal transfer image-receiving sheets of Examples B1 to B5 and Comparative Examples B1 to B4 are given in Table B1. The evaluation was carried out by the following methods.

1) Thickness of expanded layer

The section of the thermal transfer image-receiving sheet was observed using a photomicrograph thereof to measure the thickness of the expanded layer (unit: $\mu$m).

2) Wrinkle and waviness of substrate sheet

The wrinkle and waviness of the substrate sheet were evaluated by visually inspecting the thermal transfer image-receiving sheet.

○ . . . Good

Δ . . . Somewhat wrinkle and waviness observed

X . . . Significant wrinkle and waviness observed

3) Surface texture

The surface texture was evaluated by visually inspecting the thermal transfer image-receiving sheet.

○ . . . Natural matte feeling like plain paper

Δ . . . Somewhat glossy

X . . . Highly glossy, and different in texture from plain paper

4) Environmental curling

The thermal transfer image-receiving sheet was cut into a 10-cm square form. The cut sheets were allowed to stand on a floor with ① the surface of the receptive layer facing upward for one sheet and ② the surface of the receptive layer facing downward for another sheet in two types of environments, that is, an environment of a temperature of 20° C. and a humidity of 30% for 2 hr and an environment of a temperature of 40° C. and a humidity of 90% for 2 hr. Thereafter, the height from the floor was measured with respect to four corners of the thermal transfer image-receiving sheet, and the average of the measured values was calculated.

○ . . . Not more than 10 mm in both environments for both sheets ① and ②

X . . . Not less than 10 mm in either or both environments for either or both sheets ① and ②

5) Quality of print

A solid image of 64/256 gradation for each of four colors of yellow, magenta, cyan and black was formed on the thermal transfer image-receiving sheet by using a sublimation dye transfer printer PHOTOMAKER manufactured by Seiko Instruments Inc. and a sublimation dye transfer sheet CH743, and the resultant print was evaluated by visual inspection.

○ . . . Good quality with dropout and lack of uniformity being unobserved

Δ . . . Somewhat unsatisfactory

X . . . Remarkable dropout and lack of uniformity

6) Printing sensitivity

A solid image of 256/256 gradation for magenta was formed on the thermal transfer image-receiving sheet by using the above printer and transfer sheet, and the reflection density was measured with a Macbeth densitometer RD-918.

○: Reflection density of not less than 1.7

Δ: Reflection density of 1.5 to less than 1.7

X: Reflection density of less than 1.5

TABLE B1

| Samples | Thickness of expanded layer | Wrinkle etc. | Surface texture | Environmental curling | Quality of print | Printing sensitivity |
|---|---|---|---|---|---|---|
| Ex. B1 | 70 | ○ | ○ | ○ | ○ | ○ |
| Ex. B2 | 65 | ○ | ○ | ○ | ○ | ○ |
| Ex. B3 | 80 | ○ | ○ | ○ | ○ | ○ |
| Ex. B4 | 65 | ○ | ○ | ○ | ○ | ○ |
| Ex. B5 | 65 | Δ | ○ | ○ | ○ | ○ |
| Comp. Ex. B1 | 45 | X | ○ | ○ | Δ | Δ |
| Comp. Ex. B2 | 40 | X | Δ | ○ | X | X |
| Comp. Ex. B3 | 45 | X | ○ | X | Δ | Δ |
| Comp. Ex. B4 | — | ○ | X | ○ | X | X |

In the thermal transfer image-receiving sheet of the present invention, an undercoat layer is first formed on a substrate sheet, and an expanded layer is formed thereon by coating. By virtue of this constitution, the coating solution for an expanded layer does not penetrate into the substrate sheet and can be easily expanded, so that an expanded layer having a high cushioning property can be formed. Further, since the penetration of the coating solution for an expanded layer into paper is prevented, it is possible to prevent the occurrence of wrinkle and waviness on the substrate sheet.

Furthermore, the functions of the undercoat layer, expanded layer and intermediate layer enable a thermal transfer image-receiving sheet having excellent print quality, printing sensitivity and other properties and paper-like texture in respect of gloss, surface geometry and the like to be provided even when ordinary paper is used as the substrate sheet.

EXAMPLE C1

A coated paper having a basis weight of 104.7 g/m$^2$ (Mitsubishi New V Matt Kote manufactured by Mitsubishi Paper Mills Limited) was provided as a substrate sheet, and a coating solution having the following composition for an undercoat layer was gravure-coated on the substrate sheet at a coverage of 5 g/m$^2$ (weight on a dry basis; the same shall apply hereinafter). The resultant coating was dried by a hot-air drier to form an undercoat layer.

Units for expressing the composition are parts by weight unless otherwise specified.

Coating Solution for Undercoat Layer

| | |
|---|---|
| Polyester resin (V600 manufactured by Toyobo Co., Ltd.) | 100 parts |
| Methyl ethyl ketone/toluene = 1/1 | 400 parts |

Then, a coating solution having the following composition for an expanded layer was gravure-coated on the undercoat layer at a coverage of 20 g/m$^2$. Thereafter, the resultant coating was dried and heated at 140° C. for 1 min by a hot-air drier to expand the microsphere.

Coating Solution for Expanded Layer

| | |
|---|---|
| EVA Emulsion (XB3647B manufactured by Tohpe Corporation) | 100 parts |
| Microsphere (551WU20 manufactured by Expancel; expansion initiation temp. = 99–104° C.) | 20 parts |
| Water | 20 parts |

Then, a coating solution having the following composition for an intermediate layer was gravure-coated on the expanded layer at a coverage of 5 g/m$^2$. Thereafter, the resultant coating was dried by a hot-air drier.

Coating Solution for Intermediate Layer

| | |
|---|---|
| Acrylic/styrene emulsion (RX832A manufactured by Nippon Carbide Industries Co., Ltd.; glass transition point = 19° C.) | 100 parts |
| Water | 20 parts |

Then, a coating solution having the following composition for a receptive layer was gravure-coated on the intermediate layer at a coverage of 3 g/m$^2$. Thereafter, the resultant coating was dried by a hot-air drier.

Coating Solution for Receptive Layer

| | |
|---|---|
| Vinyl chloride/vinyl acetate copolymer (#1000D manufactured by Denki Kagaku Kogyo K.K.) | 100 parts |
| Amino-modified silicone (X22-349 manufactured by The Shin-Etsu Chemical Co., Ltd.) | 3 parts |
| Epoxy modified silicone (KF-393 manufactured by The Shin-Etsu Chemical Co., Ltd.) | 3 parts |
| Methyl ethyl ketone/toluene = 1/1 | 400 parts |

A coating solution having the following composition for a back surface layer was gravure-coated on the substrate sheet on its side remote from the receptive layer at a coverage of 0.05 g/m$^2$. Thereafter, the resultant coating was dried by means of a cold-air dryer, thereby preparing a thermal transfer image-receiving sheet of Example C1.

Coating Solution for Back Surface Layer

| | |
|---|---|
| Polyvinyl alcohol (PVA124 manufactured by Kuraray Co., Ltd.) | 2 parts |
| Water | 100 parts |

EXAMPLE C2

A thermal transfer image-receiving sheet of Example C2 was prepared in the same manner as in Example C1, except that a coated paper having a basis weight of 127.9 g/m$^2$ (OK Coat manufactured by New Oji Paper Co., Ltd.) was provided as a substrate sheet, and the compositions of the undercoat layer, expanded layer and intermediate layer were varied as follows.

Coating Solution for Undercoat Layer

| | |
|---|---|
| Acrylic resin (EM manufactured by Soken Chemical Engineering Co., Ltd.) | 100 parts |
| Precipitated barium sulfate (#300 manufactured by Sakai Chemical Co., Ltd.) | 30 parts |
| Toluene | 400 parts |

Coating Solution for Expanded Layer

| | |
|---|---|
| Styrene/acrylic emulsion (RX941A manufactured by Nippon Carbide Industries Co., Ltd.) | 100 parts |
| Microsphere (F30VS manufactured by Matsumoto Yushi Kagaku K.K., Japan; expansion initiation temp. = 80° C.) | 10 parts |
| Water | 20 parts |

Coating Solution for Intermediate Layer

| | |
|---|---|
| Acrylic emulsion (completely self-crosslinking type; glass transition temp. = −5° C.) (FX337C manufactured by Nippon Carbide Industries Co., Ltd.) | 100 parts |
| Water | 20 parts |

EXAMPLE C3

A thermal transfer image-receiving sheet of Example C3 was prepared in the same manner as in Example C1, except that a thermal transfer paper having a basis weight of 79.1 g/m$^2$ (TTR-T manufactured by Mitsubishi Paper Mills, Ltd.) was provided as a substrate sheet, and the compositions of the undercoat layer, expanded layer and intermediate layer were varied as follows.

Coating Solution for Undercoat Layer

| | |
|---|---|
| Urethane resin (NL2371M30 manufactured by Mitsui Toatsu Chemicals, Inc.) | 100 parts |
| Titanium oxide (TCA888 manufactured by Tohchem Products Corporation) | 30 parts |
| Ethyl acetate | 100 parts |
| Dimethylformamide | 20 parts |
| Isopropanol | 300 parts |

Coating Solution for Expanded Layer

| | |
|---|---|
| Acrylic emulsion (AE312 manufactured by Japan Synthetic Chemicals, Inc.) | 100 parts |
| Microsphere (F30SS manufactured by Matsumoto Yushi Kagaku K.K., Japan; expansion initiation temp. = 80° C.) | 15 parts |
| Water | 20 parts |

Coating Solution for Intermediate Layer

| | |
|---|---|
| Acrylic ester emulsion (glass transition temp. = −19° C.) (RX669R manufactured by Nippon Carbide Industries Co., Ltd.) | 100 parts |
| Titanium oxide (TT-055 (A) manufactured by Ishihara Sangyo Kaisha Ltd.) | 50 parts |
| Water | 30 parts |

EXAMPLE C4

A thermal transfer image-receiving sheet of Example C4 was prepared in the same manner as in Example C1, except that a completely self-crosslinking type acrylic emulsion (FX6074 manufactured by Nippon Carbide Industries Co., Ltd.; glass transition temp.=7° C.) was used instead of the resin for an intermediate layer of Example C1.

EXAMPLE C5

A thermal transfer image-receiving sheet of Example C5 was prepared in the same manner as in Example C2, except that the composition of the undercoat layer in Example C2 was varied as follows. Further the formation of the back surface layer was omitted.

Coating Solution for Undercoat Layer

| | |
|---|---|
| Acrylic emulsion (AE932 manufactured by Japan Synthetic Chemicals, Inc.) | 100 parts |
| Water | 20 parts |

EXAMPLE C6

A thermal transfer image-receiving sheet of Example C6 was prepared in the same manner as in Example C1, except that an acrylic emulsion (AE20 manufactured by Japan Synthetic Chemicals, Inc.; glass transition temp.=−45° C.) was used instead of the resin for an intermediate layer of Example C4.

COMPARATIVE EXAMPLE C1

A thermal transfer image-receiving sheet of Comparative Example C1 was prepared in the same manner as in Example C1, except that the formation of the intermediate layer was omitted.

COMPARATIVE EXAMPLE C2

A thermal transfer image-receiving sheet of Comparative Example C2 was prepared in the same manner as in Example C2, except that the formation of the intermediate layer was omitted.

COMPARATIVE EXAMPLE C3

A thermal transfer image-receiving sheet of Comparative Example C3 was prepared in the same manner as in Example C3, except that the formation of the undercoat layer and back surface layer was omitted.

COMPARATIVE EXAMPLE C4

A thermal transfer image-receiving sheet of Comparative Example C4 was prepared in the same manner as in Example C1, except that the composition of the intermediate layer was varied as follows.

Coating Solution for Intermediate Layer

| | |
|---|---|
| Acrylic resin (Dianal BR85 manufactured by Mitsubishi Rayon Co., Ltd.) | 200 parts |
| Toluene | 200 parts |
| Ethyl acetate | 300 parts |

The results of evaluation for the thermal transfer image-receiving sheets of Examples C1 to C6 and Comparative Examples C1 to C4 are given in Tables C1 and C2. The evaluation was carried out by the following methods.

1) Thickness of expanded layer

The section of the thermal transfer image-receiving sheet was observed using a photomicrograph thereof to measure the thickness of the expanded layer (unit: $\mu$m).

2) Wrinkle and waviness of substrate sheet

The wrinkle and waviness of the substrate sheet were evaluated by visually inspecting the thermal transfer image-receiving sheet.

○: Good

Δ: Somewhat wrinkle and waviness observed

X: Significant wrinkle and waviness observed

3) Tackiness of cut end face

For each image-receiving sheet, 20 sheets were put on top of one another and cut with a table paper cutter, and the tackiness (stickiness) of the cut end face was evaluated by touch.

○: Not tacky

Δ: Somewhat tacky

X: Very tacky

4) Surface texture

The surface texture was evaluated by visually inspecting the thermal transfer image-receiving sheet.

○ . . . Natural matte feeling like plain paper

Δ . . . Somewhat glossy

X . . . Highly glossy, and different in texture from plain paper.

5) Environmental curling

The thermal transfer image-receiving sheet was cut into a 10-cm square form. The cut sheets were allowed to stand on a floor with ① the surface of the receptive layer facing upward for one sheet and ② the surface of the receptive layer facing downward for another sheet in two types of environments, that is, an environment of a temperature of 20° C. and a humidity of 30% for 2 hr and an environment of a temperature of 40° C. and a humidity of 90% for 2 hr. Thereafter, the height from the floor was measured with respect to four corners of the thermal transfer image-receiving sheet, and the average of the measured values was calculated.

○ . . . Not more than 10 mm in both environments for both sheets ① and ②

X . . . Not less than 10 mm in either or both environments for either or both sheets ① and ②

6) Quality of print

A solid image of 64/256 gradation for each of four colors of yellow, magenta, cyan and black was formed on the thermal transfer image-receiving sheet by using a sublimation dye transfer printer PHOTOMAKER manufactured by Seiko Instruments Inc. and a sublimation dye transfer sheet CH743, and the resultant print was evaluated by visual inspection.

○ . . . Good quality with dropout and lack of uniformity being unobserved

Δ . . . Somewhat unsatisfactory

X . . . Remarkable dropout and lack of uniformity

7) Printing sensitivity

A solid image of 256/256 gradation for magenta was formed on the thermal transfer image-receiving sheet by using the above printer and transfer sheet, and the reflection density was measured with a Macbeth densitometer RD-918.

○: Reflection density of not less than 1.7

Δ: Reflection density of 1.5 to less than 1.7

X: Reflection density of less than 1.5

8) Matting

The surface of a print formed under the same conditions as those described above in connection with the measurement of the printing sensitivity was evaluated by visual inspection.

○: No matte feeling observed

Δ: Somewhat matte feeling observed

X: Significant matte feeling observed

TABLE C1

| Samples | Thickness of expanded layer | Wrinkle etc. | Tackiness on end face | Surface texure |
|---|---|---|---|---|
| Ex. C1 | 70 | ○ | ○ | ○ |
| Ex. C2 | 65 | ○ | ○ | ○ |
| Ex. C3 | 80 | ○ | ○-Δ | ○ |
| Ex. C4 | 65 | ○ | ○ | ○ |
| Ex. C5 | 65 | Δ | ○ | ○ |
| Ex. C6 | 65 | ○ | X | ○ |
| Comp. Ex. C1 | 50 | ○ | ○ | Δ |
| Comp. Ex. C2 | 45 | ○ | ○ | Δ |
| Comp. Ex. C3 | 70 | ○ | ○ | ○ |
| Comp. Ex. C4 | 55 | ○ | ○ | Δ |

TABLE C2

| Samples | Environ-mental curling | Quality of print | Printing sensi-tivity | Matting |
|---|---|---|---|---|
| Ex. C1 | ○ | ○ | ○ | Δ |
| Ex. C2 | ○ | ○ | ○ | ○ |
| Ex. C3 | ○ | ○ | ○ | Δ |
| Ex. C4 | ○ | ○ | ○ | ○ |
| Ex. C5 | X | ○ | ○ | ○ |
| Ex. C6 | ○ | ○ | Δ | Δ-X |
| Comp. Ex. C1 | ○ | X | X | Δ-X |
| Comp. Ex. C2 | ○ | X | X | Δ-X |
| Comp. Ex. C3 | ○ | Δ-X | ○ | ○ |
| Comp. Ex. C4 | ○ | X | Δ | ○ |

In the thermal transfer image-receiving sheet of the present invention, high cushioning property and heat insulating properties of an expanded layer can remain unchanged by virtue of the function of an intermediate layer comprising an aqueous coating.

Further, the surface of the expanded layer is finely uneven due to the influence of an expanding agent, and the surface can be kept uneven. This enables a thermal transfer image-receiving sheet having a high image quality to be prepared while enjoying natural matte feeling.

What is claimed is:

1. A thermal transfer image-receiving sheet comprising paper as a substrate sheet and, provided on said substrate sheet in the following order, an expanded layer and a receptive layer, an undercoat layer being provided between said substrate sheet and said expanded layer, said expanded layer containing a microcapsule.

2. The thermal transfer image-receiving sheet according to claim 1, wherein said undercoat layer has been formed by coating a coating solution comprising a resin and an organic solvent.

3. The thermal transfer image-receiving sheet according to claim 2, wherein said undercoat layer further comprises a pigment.

4. The thermal transfer image-receiving sheet according to claim 1, wherein said expanded layer has been formed by coating an aqueous coating solution.

5. The thermal transfer image-receiving sheet according to claim 4, wherein the cell diameter of said expanded layer is in the range of from 20 to 50 $\mu$m.

6. The thermal transfer image-receiving sheet according to claim 1, wherein said expanded layer contains a microcapsule comprising a low-boiling organic solvent surrounded by the wall of a thermoplastic resin.

7. The thermal transfer image-receiving sheet according to claim 1, wherein said expanded layer has a thickness in the range of from 30 to 100 $\mu$m.

8. The thermal transfer image-receiving sheet according to claim 1, which further comprises a curl preventive layer on the other surface of said substrate sheet.

9. A thermal transfer image-receiving sheet comprising a substrate sheet of paper composed mainly of pulp and, provided on said substrate sheet in the following order, an expanded layer, an intermediate layer and a receptive layer, said intermediate layer having been formed by coating an aqueous coating solution.

10. The thermal transfer image-receiving sheet according to claim 9, wherein said aqueous coating solution is an aqueous solution of a water-soluble resin, a dispersion of a resin or an emulsion of a resin.

11. The thermal transfer image-receiving sheet according to claim 9, wherein said resin constituting said intermediate layer has a glass transition temperature in the range of from −30 to 20° C.

12. The thermal transfer image-receiving sheet according to claim 9, wherein said resin constituting said intermediate layer is a crosslinking resin.

13. The thermal transfer image-receiving sheet according to claim 9, wherein an undercoat layer is provided between said substrate sheet and said expanded layer.

* * * * *